US006000596A

United States Patent [19]

Cariati

[11] Patent Number: 6,000,596

[45] Date of Patent: Dec. 14, 1999

[54] APPARATUS FOR FEEDING RIVETS FOR RIVETING GUNS

[75] Inventor: Vincenzo Cariati, Bologna, Italy

[73] Assignee: Far S.r.l., Bologna, Italy

[21] Appl. No.: 08/931,690

[22] Filed: Sep. 16, 1997

[30] Foreign Application Priority Data

Sep. 20, 1996 [IT] Italy ..... BO96A0470

[51] Int. Cl.[6] ..... B21J 15/28

[52] U.S. Cl. ..... 227/112; 227/119; 227/139

[58] Field of Search ..... 227/135, 137, 227/139, 112, 119; 72/391.6

[56] References Cited

U.S. PATENT DOCUMENTS

| | | | |
|---|---|---|---|
| 1,980,967 | 11/1934 | De Mooy | 227/112 |
| 3,488,825 | 1/1970 | Lundgren | 227/112 |
| 3,906,615 | 9/1975 | Campbell | 227/112 |
| 4,720,215 | 1/1988 | Arena | 227/112 |
| 4,811,881 | 3/1989 | Heck | 227/112 |
| 5,014,876 | 5/1991 | Young | 221/112 |
| 5,390,524 | 2/1995 | Higgs | 72/391.6 |
| 5,653,368 | 8/1997 | Miles | 227/135 |

FOREIGN PATENT DOCUMENTS

BO95A0329 6/1995 Italy .

*Primary Examiner*—Peter Vo
*Assistant Examiner*—James P. Calve
*Attorney, Agent, or Firm*—Fay, Sharpe, Fagan, Minnich & McKee, LLP

[57] ABSTRACT

An apparatus for feeding rivets for riveting guns comprises a first duct for transporting the rivets to a front arming device of a riveting gun; the first duct is connected to a source of compressed air supplying the compressed air at a first determined pressure, and a first pressure reducing element to impart the air flowing along the first duct a second determined pressure, and a first solenoid valve to control the outflow of compressed air through the first pressure reducing element; it also comprises a second duct connected at one of its ends to a source of compressed air and with its other end connected to a portion of the first duct positioned in proximity of the front arming device, along the second duct flowing compressed air at the first determined pressure higher than the second determined pressure which flows inside the first duct.

7 Claims, 3 Drawing Sheets

APPARATUS FOR FEEDING RIVETS FOR RIVETING GUNS

BACKGROUND OF THE INVENTION

The present invention relates to a rivet feeding apparatus for riveting guns.

The present apparatus is used specifically for automatically and continuously arming tear-off rivets pre-mounted on the tear-off nail.

Particular reference is made to a device of the type comprising: a conveyor for rivets fitted with nail and collar, on which the rivets advance one after the other hanging by the collar with the nail facing downward; a device for upsetting the rivets exiting the conveyor, means for transporting the rivets from the upsetting device to a front arming device; and a front arming device provided to load the rivets onto a riveting gun.

In devices of this kind the aforesaid conveyor comprises a pneumatic feed tube in which the rivets advance with the nail facing backward with respect to the direction of travel; the upsetting device receives a rivet which exits the conveyor with the nail facing downward and arranges it with the nail facing upward and facing an inlet of the pneumatic feed tube; the rivet is pushed into the tube by the action of the compressed air and is hurled towards the arming device.

This known apparatus presents some drawbacks; at the origin of such drawbacks is the fact that the compressed air used to transport the rivets along the aforesaid feed tube presents quite a high pressure, usually equal to 6 bar, which is the same as that utilized in other "power" sections of the riveting guns, used for arriving and setting the rivet in place. Because of the use, in the aforesaid feed tube, of such a high pressure the rivet attains a very high speed and a large amount of kinetic energy, and it may occur that, having violently stricken a portion of the arming pincer, the rivet nail could depart the related seat in an uncontrolled manner.

This could be dangerous for personnel tasked with using the rivet gun.

Moreover, compressed air consumption is quite high and the pneumatic ducts within which the rivets transit to reach their arming section are subjected to intense wear.

SUMMARY OF THE INVENTION

Object of the present invention is to obviate the aforesaid limitations and drawbacks of the prior art.

The invention, as it is characterized by the claims, solves the problem of providing an apparatus for feeding rivets for riveting guns, comprising pneumatic conveyor means able to feed the rivets to an arming device of a riveting gun, and being connected at least to one source of compressed air feeding the compressed air at a first determined pressure wherein the pneumatic conveyor means comprise a first and a second duct. The first duct defines the route along which the rivets are destined to flow and being at least provided first means for regulating pressure shaped and arranged in such a way as to impose to the air acting along the first duct a second determined pressure; the second duct presenting one end, opposite to a second end connected to the source of compressed air, connected to a portion of the first duct arranged in proximity of the arming device. The second determined pressure which acts along the first duct is smaller than the first determined pressure which acts along the second duct.

BRIEF DESCRIPTION OF THE DRAWINGS

The technical characteristics of the invention, according to the aforesaid purposes, can be clearly seen from the content of the claims reported below, and its advantages shall be made more evident in the detailed description which follows, made with reference to the attached drawings, which show an embodiment provided purely by way of non limiting example, in which:

DESCRIPTION OF THE PREFERRED EMBODIMENTS

Figure 2:
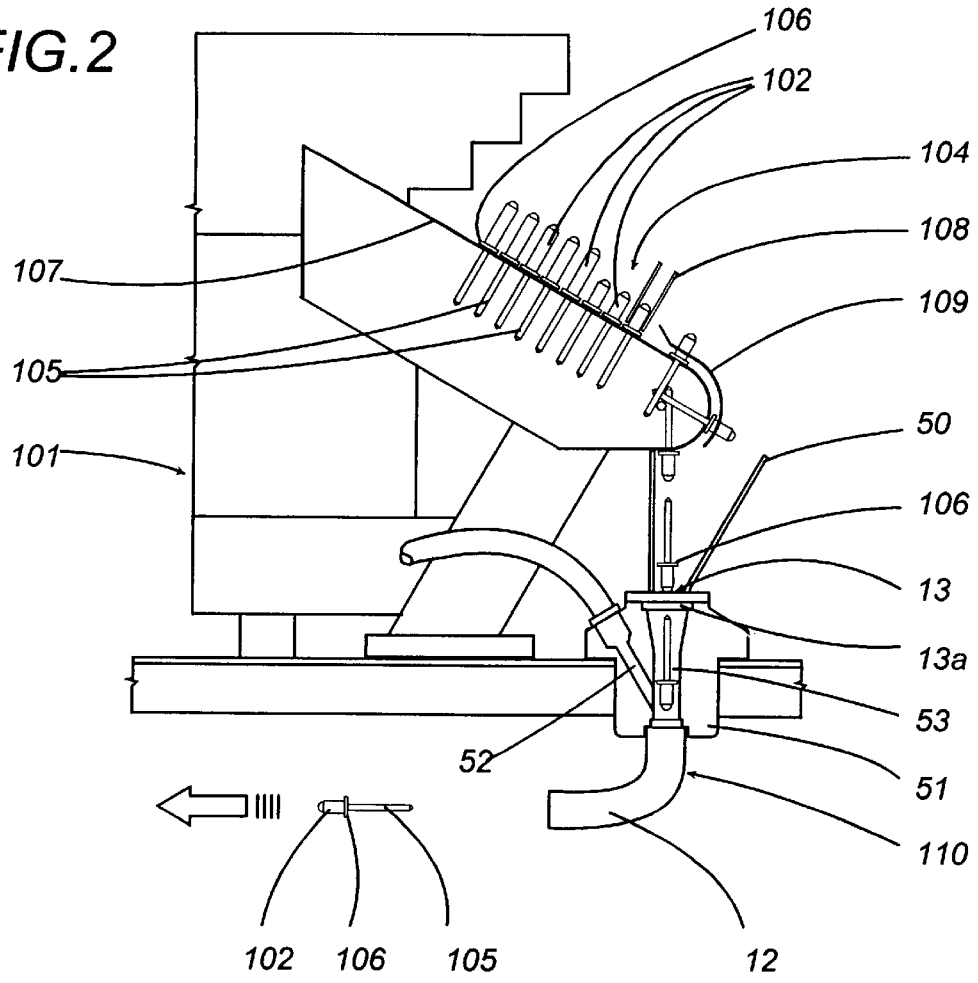
FIG. 2 shows, partially in section, a side view of some details of the rivet feeding apparatus as per FIG. 1.
Figure 3:
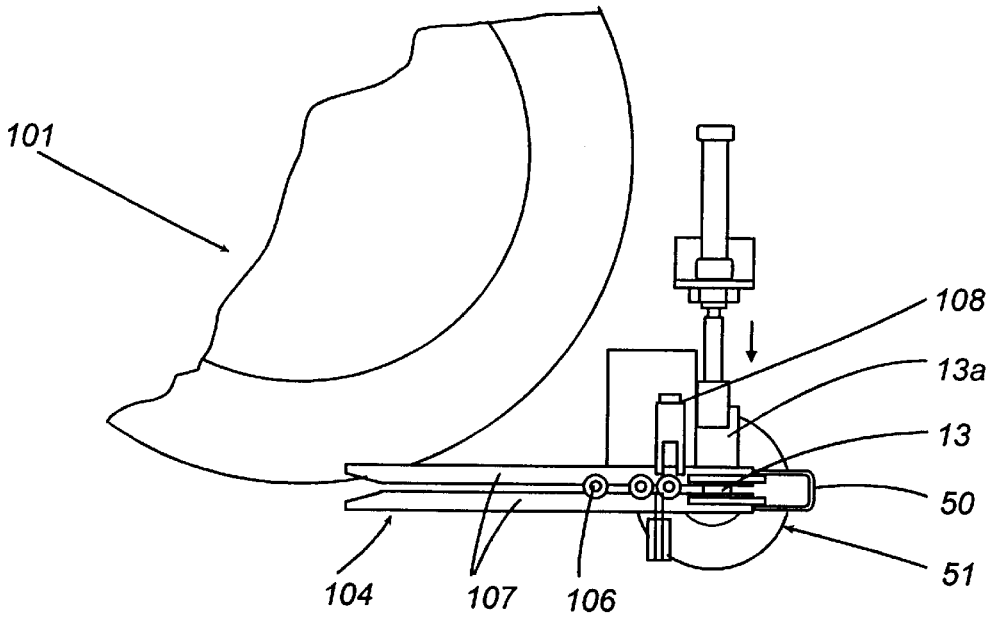
FIG. 3 shows a plan view of the details in FIG. 2.
Figure 4:
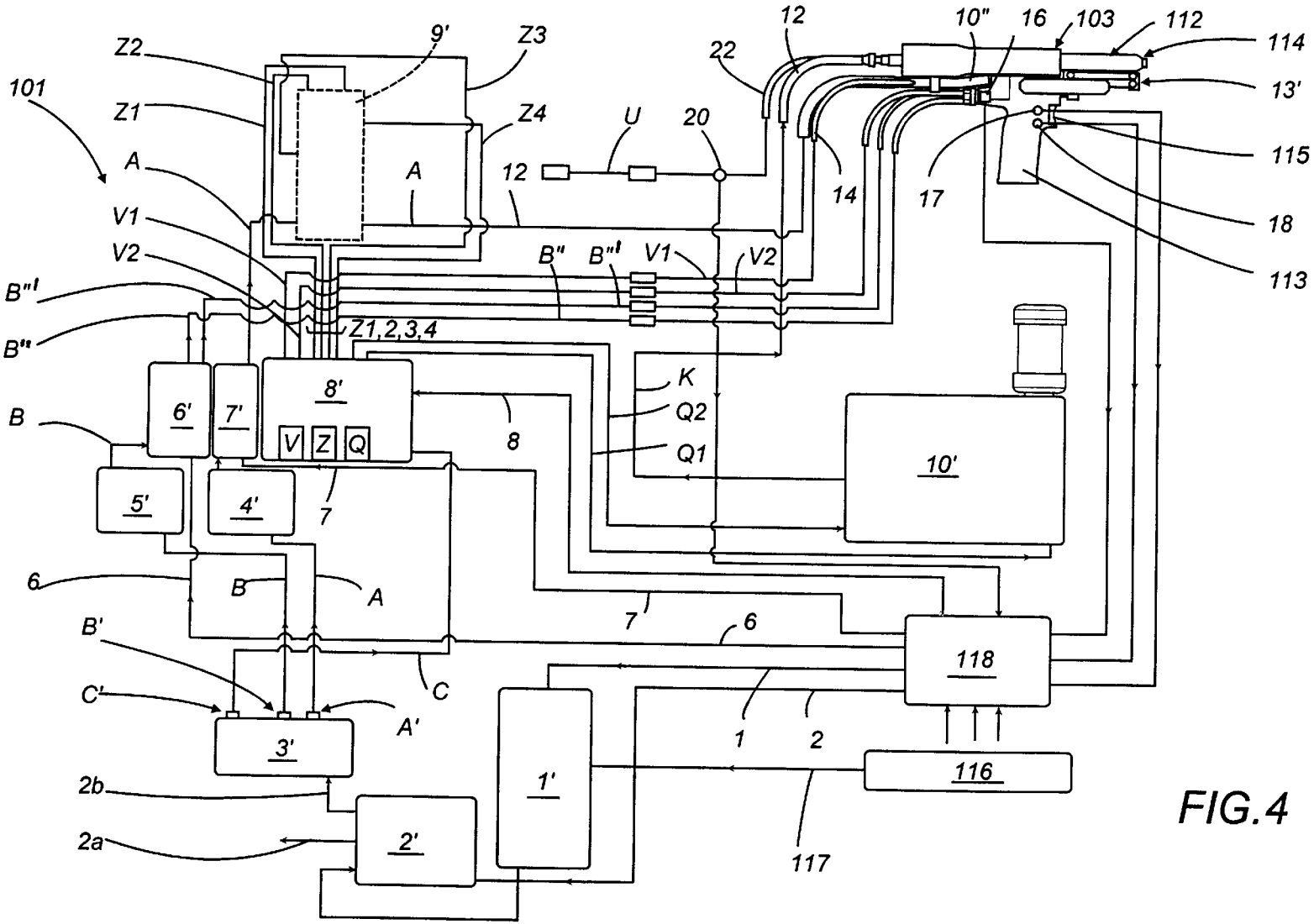
FIG. 4 shows, in block diagram form, an additional portion of the rivet feeding apparatus as per the previous figures.

In accordance with the attached figures, and particularly with FIGS. 2, 3 and 4, the designation 101 indicates in its entirety an apparatus for feeding rivets 102 for rivet guns 103.

The apparatus 101 comprises a vibration conveyor 104 for tear-off rivets 102 provided with nail 105 and collar 106. The conveyor 104, which is housed inside an enclosed, track-mounted base not shown, is provided with a track 107, tilted, whereon the rivets 102 slide, one after the other, hanging by the collar 106 with the nail 105 facing downward.

On the conveyor 104 is set up an arresting element 108 able to move between two positions in which, respectively, it blocks and lets pass through the rivets 102 on the track 107. The arresting element 108 lets the rivets 102 move forward one at a time upon external command The apparatus 101 also comprises a device 109 for upsetting the rivets 102 exiting the conveyor 104 and means 110 for transporting the rivets 102 themselves to a front warning device 111 which loads the rivets 102 onto a riveting gun 103 having a stock 112 and a grip 113. The forward end of the stock 112 is fitted with a head 114 and the grip 113 is provided with a control push-button 115. The described means 110 for transporting the rivets 102 include a conveyor element comprising a duct 12 for low pressure compressed air, partly inside the aforesaid base not shown and provided with an upward facing inlet 13 for the rivets 102. More specifically, the inlet 13 is provided with a shutter 13*a* which opens and shuts the inlet 13 itself, which communicates with the bottom of a loading hopper 50 able to receive the rivets 102 from the vibrating conveyor 104. The rivets 102, therefore, fall into a duct 53 of a receiving element 51. The receiving element 51 is provided with an additional duct 52 communicating, at one of its ends, with the aforesaid internal duct 53, and at its other end with a source of compressed air 116 (FIG. 4), by means of a pneumatic duct A.

An end portion of the first duct 12, located in proximity of the inlet 13, communicates, therefore, through the ducts 53 and 52 of the receiving element 51 and with the pneumatic duct A, in a manner which shall be clarified further on, with a source of compressed air represented schematically with a block 116 in FIG. 4. The other end (not shown) of the first duct 12 is connected to the aforesaid front arming device 111. Inside the aforesaid base, not shown, is fitted the aforesaid source of compressed air 116.

What has been described thus far refers to characteristics common to the known apparatuses, described for instance in the Italian patent application No. BO95A 000329 and in the corresponding European patent application No. 96830296.8 by the same Applicant, which is recalled herein for the sake of providing a complete description, as well as to the subject one.

According to the present invention and to what is shown, in particular, in FIG. 4, the aforesaid source of compressed air 116 which feeds compressed air at a first determined pressure, communicates, through a duct 117, with a filter 1', one of whose outlets is connected to an inlet of a threeway solenoid valve 2'. This solenoid valve 2', in its normal working condition, lets compressed air flow through the entire system; if, instead, the system experiences a malfunction or an overpressure occurs, or when the operator needs to intervene to perform, for instance, maintenance operations, the solenoid valve 2' unloads the system through its own duct indicated as 2*a*.

Under normal operating conditions of the apparatus 101, an outlet 2*b* of the solenoid valve 2' is open and it dispenses compressed air towards the remaining portions of the system, whereas under critical conditions the solenoid valve 2' interrupts air delivery and lets the system unload.

The outlet 2*b* of the solenoid valve 2' is connected to the inlet of a distributor block 3'.

This distributor 3' presents three outlets, connected as follows:

first outlet A': a corresponding pneumatic duct A reaches a block 9' (which will be discussed further on) and connects to the aforesaid duct 12 for hurling the rivets 102. In particular, duct A exits blocks 3' and enters a block 4', which comprises a reducer or pressure regulating element which reduces the pressure of the compressed air from its value of first determined pressure to a second determined pressure, usually with a relatively modest value (preferably equal to two bar) with respect to the delivery value of the aforesaid source of compressed air 116. The block 4' in turn is connected at its output to the input of a block 7', which comprises a first solenoid valve feeding the aforesaid block 9' in one of its parts destined to hurling the rivets 102 through the foresaid duct 12 (see in particular FIG. 1);

second outlet B': a corresponding pneumatic duct B reaches a block 5', which comprises a second reducer or pressure regulating element whose task is to reduce the pressure of the air coming from the aforesaid source of compressed air and which therefore presents the aforesaid first determined pressure, to a value essentially equal to said second predetermined pressure, equal to two bar. The block 5' is connected at its output to a block 6', which comprises a third solenoid valve presenting two outlets connected respectively to two ducts B" and B". The fifth and sixth ducts B'" and B'" are both connected to the riveting gun 103 and allow, in a way that is known and not described hereafter, the movement of the front arming device 111 of the rivets 102 in order to arm the riveting gun 103 itself. It is deemed sufficient to state that the fifth and sixth ducts B" and B'" move the arming device 111 of the pistol 103 between the two positions of loading and awaiting the rivet 102 which arrives along the aforesaid first duct 12;

third outlet C': a corresponding duct C at high pressure not subjected to reductions, and thus essentially equal to the aforesaid first determined pressure supplied by the source of compressed air 116, essentially equal to six bar, enters a block 8', and feeds three solenoid valves V, Z and Q which comprise said block 8'. In particular, the solenoid valve Q feeds two outgoing ducts Ql and Q2 that lead to the inlet of a block 10', which contains a hydraulic piston which under the action of the airjets coming from the solenoid valve Q moves pressurizing fluid; this fluid, through an outlet duct K, reaches the pistol 103, and specifically it reaches the assembly for drawing and hurling the nail 105 of the rivet 102.

From the second solenoid valve V depart second and third ducts V1 and V2:

the second duct V1, as shall be made clear further on, is devoted to delivering air at the aforesaid first determined pressure (six bar pressure) to hurl the rivet 102 in correspondence with a terminal portion of the duct 12, in correspondence with which an end of the second duct V1 itself enters the first duct 12 (see FIG. 1); this second duct V1, in conjunction with the duct 12, shall also be defined, hereinafter, with the term "conveying means" for the rivets 102;

the third duct V2 is the channel that supplies the gun 103 with the pressure for returning the nail OS once it has been drawn from the rivet 102. The third duct V2 connects back within the gun (in a known way) to a fourth duct 22, through which pass the drawn nails 105 (the ones that have been used and no longer have the rivet); the fourth duct 22 is essentially the nail-ejection outlet, and it ends in correspondence with an outlet unit U. Note that, in the apparatus 101, to expel the used nails 105 there is an actual active pressure.

From the solenoid valve Z depart four ducts respectively indicated as Z1, Z2, Z3 and Z4; these ducts are used, in a way known in the prior art, to determine the selection of the nails 105 along the conveyor 104, acting and moving the arresting element 108, and to command the movement of the shutter 13*a* thus determining the closure and opening of the duct 12 itself in order to regulate the pressure within it.

The apparatus 101 includes a control element comprising a programmable PLC 118 which commands the entire operating logic assembly and which receives information from sensors to be described farther on.

From PLC 118 depart the command signals which go to command the various aforesaid blocks. The signal 1 commands the block 1', the signal 2 the block 2', the signal 6 the solenoid valve 6', the signal 7 the solenoid valve 7'and the signal 8 the group of solenoid valves V, Z, Q.

Entering as inputs to PLC 118 are signals coming from four sensors indicated respectively as 16, 17, 18 and 20 (FIG. 4). More specifically, as shall be made clearer further on, the sensors 17 and 18 constitute the contact of a switch 15 of the riveting gun 103.

The sensor 16 is a proximity sensor which detects the position of the front arming device 111: if this position is not correct, the sensor 16 does not intervene, whereas it sends a signal to the PLC 118 only if the position of the front arming device 111 is not correct; if the sensor 16 emits this signal, the supply of rivets 102 to the pistol 103 is shut off, for instance by closing the solenoid valve 7'.

The sensor 20 is provided in correspondence with the outlet U of the nails 105, to verify that the exit of the nails 105 themselves occurs properly and that the duct U is not obstructed.

The sensors 17 and 18 are the command sensors associated with the push-button 115 for activating the gun 103.

Hereafter the operation of the apparatus 101 is described starting from the moment when, upon external command, the arresting element 108 allows a rivet 102 to be advanced on track 107.

At the end of this advance, and in ways described in the mentioned Italian patent application No. BO95A 000329, after leaving the track 107 the rivet is upside down with the related nail 105 facing upward, and it falls inside the first duct 53 of the receiving element 51. From here it arrives inside the duct 12 to be transported towards the arming device 111.

According to the present invention, and in accordance with what has been stated previously, each rivet 102 transits inside the first duct 12, to the junction area between the first duct 12 itself and the second duct V1, under the action of a flow of compressed air subjected to a two bar pressure.

Figure 1:
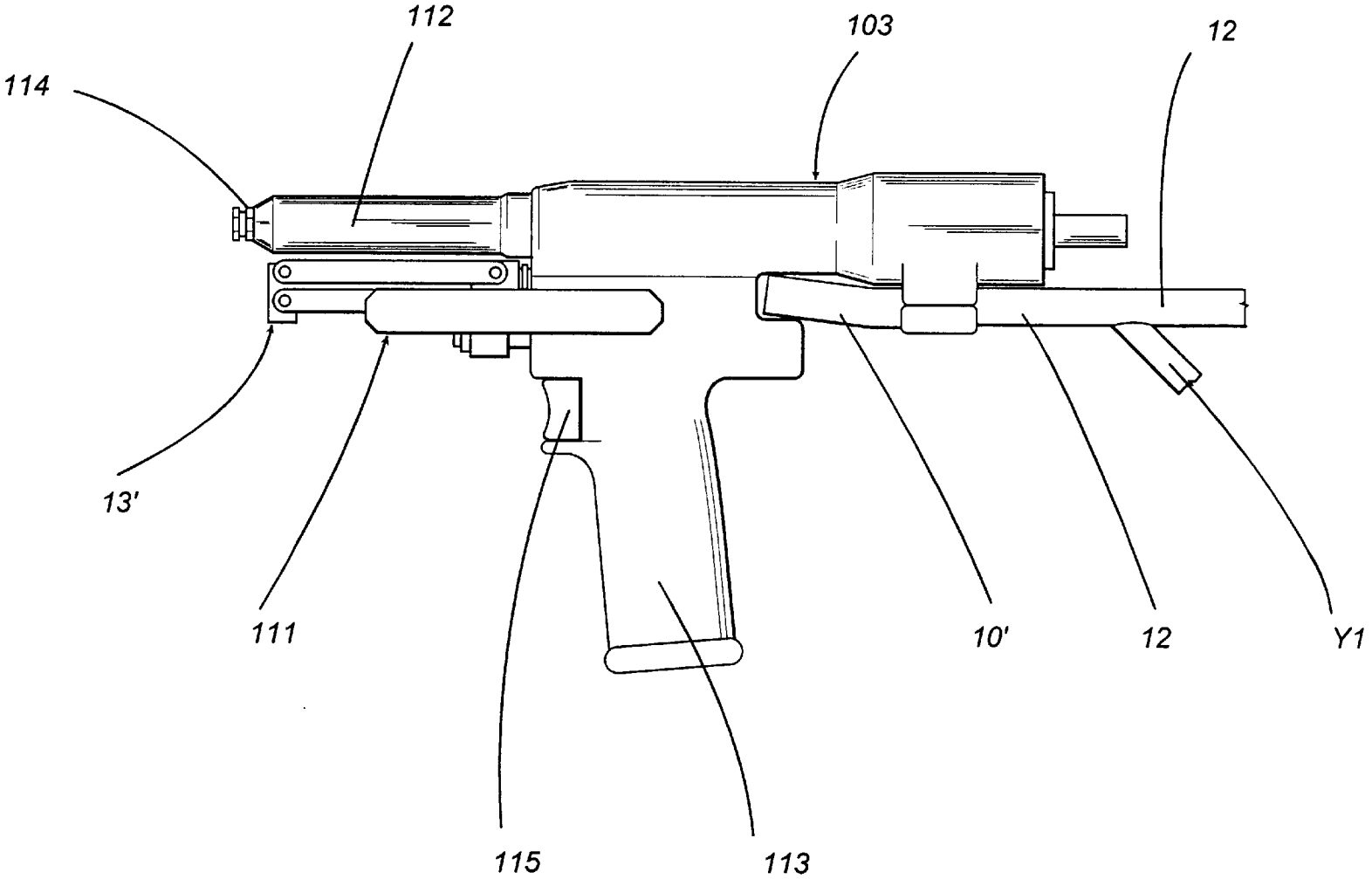
FIG. 1 shows a side view of the rivet gun to which is associated a rivet feeding apparatus according to the present invention.

This transfer occurs with very precise times, and thus with a timing set up in advance in the PLC 118 as a function thereof, once the pre-set period of time within which the rivet 102 must reach its arming position has expired, the high pressure circuit V1 immediately intervenes thanks to the activation of the solenoid valve V by the PLC 118 itself The fact that the high pressure circuit V2 is joined in the terminal section of the low pressure first duct 12 enables precise arming of the rivet 102, which due to its low transfer pressure towards gun 103 could improperly position itself with respect to the arming pincer 13' shown schematically in FIGS. 1 and 4.

If for any reason the rivet 102 should fail to insert itself correctly in the arming channel 10" shown in FIGS. 1 and 4, it would be dragged into its correct position by the high pressure fluid coming from the second duct V1. This would not entail any practical problem, since the aforesaid first determined pressure would act only along a short section of the first duct 12, the short section the rivet 102 needs to reach the correct position.

It is important to stress the fact that low pressure operation of the low pressure first duct 12 ends the instant the rivet 102 reaches its correct arming position in the pincer 13'.

Note that the use of the low pressure first duct 12, associated with the second duct V in the described manner, allows to solve the aforesaid safety problems for personnel tasked with using the pistol 103. Moreover, air consumption in the system is markedly reduced, and reduced is also the wear in the ducts within which the rivets 102 transit to reach the riveting gun 103.

What is claimed:

1. Apparatus for feeding rivets for riveting guns, comprising:

pneumatic conveyor means, which feed the rivets to an arming device of a riveting gun, and being connected at least to one source of compressed air supplying the compressed air at a first determined pressure, wherein said pneumatic conveyor means comprises:

a first duct and a second duct, said first duct defining the route along which the rivets are destined to travel and being at least provided first pressure regulating means which impose to the air acting along said first duct a second determined pressure, wherein said first pressure regulating means comprises at least one pressure reducer;

said second duct comprising:

a first end, connected to a portion of said first duct positioned in proximity of said arming device, and a second end connected to said source of compressed air, wherein said first and second ends are opposite each other, said second determined pressure which acts along said first duct being lower than said first determined pressure which acts along said second duct;

a first valve means which controls the flow of the compressed air through said first pressure regulating means and sends the compressed air inside said first duct at said second determined pressure;

a second valve means which controls the flow of compressed air coming from said source of compressed air and sends the compressed air inside said second duct at said first determined pressure, said second valve means controls the flow of compressed air coming from said source of compressed air and sends the compressed air inside a third duct which in turn feeds a fourth duct for ejecting the nails once they have been used inside the riveting gun to drive the rivets, so that in said ejection duct an active pressure is present for hurling the nails;

fifth and sixth ducts which move the arming device of said rivets;

a second pressure regulating means which is positioned and shaped to impart to the air acting along said fifth and sixth ducts said second determined pressure, said second pressure resulting means comprises at least one pressure reducer; and a third valve means which controls the flow of the compressed air through said second pressure regulating means.

2. Apparatus according to claim 1, further comprising governing means to control the operation of said first, second and third valve means.

3. Apparatus according to claim 1 wherein said first pressure regulating means impart to the compressed air which flows along said first duct, a pressure essentially equal to two bar.

4. Apparatus according to claim 1 wherein said second pressure regulating means impart to the compressed air transition along said fifth and sixth ducts, a pressure essentially equal to two bar.

5. Apparatus for feeding rivets for riveting guns, comprising:

pneumatic conveyor means which feed the rivets to an arming device of a riveting gun, and being connected at least to one source of compressed air supplying the compressed air at a first determined pressure, wherein said pneumatic conveyor means comprise:

a first duct and a second duct, said first duct defining the route along which the rivets are destined to travel and being at least provided first pressure regulating means shaped and positioned to impart to the air acting along said first duct a second determined pressure wherein said first pressure regulating means comprises at least one pressure reducer;

said second duct comprising:

a first end, connected to a portion of said first duct positioned in proximity of said arming device, and a second end connected to said source of compressed air, wherein said first and second ends are opposite each other;

wherein said second determined pressure which acts along said first duct is lower than said first determined pressure which acts along said second duct;

a first valve means which controls the flow of the compressed air through said first pressure regulating means and sends the compressed air inside said first duct at said second determined pressure;

a second valve means which controls the flow of compressed air coming from said source of compressed air and sends the compressed air inside said second duct at said first determined pressure, said second valve means controls the flow of compressed air coming from said source of compressed air and sends the compressed air inside a third duct which in turn feeds a fourth duct for ejecting the nails once they have been used inside the riveting gun to drive the rivets, so that in said election duct an active pressure is present for hurling the nails;

fifth and sixth ducts which move the arming device of said rivets;

a second pressure regulating means which imparts to the air acting along said fifth and sixth ducts said second determined pressure wherein said second pressure regulating means comprises at least one pressure reducer;

a third valve means which controls the flow of the compressed air through said second pressure regulating means; and governing means to control the operation of said first, second and third valve means.

6. Apparatus according to claim 5, wherein said first pressure regulating means impart to the compressed air which flows along said first duct, a pressure essentially equal to two bar.

7. Apparatus according to claim 5, wherein said second pressure regulating means impart to the compressed air transition along said fifth and sixth ducts, a pressure essentially equal to two bar.

* * * * *